US006895612B1

(12) United States Patent
Hamilton

(10) Patent No.: US 6,895,612 B1
(45) Date of Patent: May 24, 2005

(54) HAMMOCK FOR SAILBOAT

(76) Inventor: Claiborne Hamilton, 1123 S. 1st St., Jacksonville, FL (US) 32250

( * ) Notice: Subject to any disclaimer, the term of this patent is extended or adjusted under 35 U.S.C. 154(b) by 0 days.

(21) Appl. No.: 10/284,388

(22) Filed: Oct. 29, 2002

(51) Int. Cl.[7] ..... A45F 3/24
(52) U.S. Cl. ..... 5/120; 5/123; 5/122
(58) Field of Search ..... 5/120, 122, 123, 5/127, 130; 114/39.12, 343, 88, 90–93, 97–99

(56) References Cited

U.S. PATENT DOCUMENTS 1,181,508 A * 5/1916 Davis ..... 5/122
3,526,909 A * 9/1970 Kotler ..... 5/123
5,327,842 A * 7/1994 Bailey ..... 114/105
5,474,010 A * 12/1995 Marcus ..... 114/105
5,788,327 A 8/1998 Gregory

* cited by examiner

*Primary Examiner*—Michael F. Trettel
*Assistant Examiner*—Fredrick Conley
(74) *Attorney, Agent, or Firm*—Lawrence J. Gibney, Jr.

(57) ABSTRACT

This is a hammock for a sailboat. This invention allows the user of this specially designed hammock to maximize the space above the cabin top. It is attached at three points of attachment as described in the application and may be attached using a variety of means.

Embodiments of this invention have been disclosed and described. It will be apparent to those skilled in the art that various modifications may be made to this invention without departing from the spirit of the invention.

1 Claim, 2 Drawing Sheets

HAMMOCK FOR SAILBOAT

CROSS REFERENCES TO RELATED APPLICATIONS

None.

STATEMENT REGARDING FEDERALLY SPONSORED RESEARCH

No federal research money was used in the development of this invention.

REFERENCE TO APPENDIX

No appendix accompanies this application.

BRIEF DESCRIPTION OF THE INVENTION

The hammock is in widespread use today but has never been successfully employed on a sailboat. One of the principal barriers to a hammock on a sailboat is the limited space that is available on the typical sailboat.

The hammock can be placed between the mast and the bow of the vessel but this position consumes much needed space that is ordinarily used for traffic on the sailboat. The placement of the hammock in that area would produce congestion and greatly limit the useable space on the sailboat.

This particular invention seeks to use the space above the main cabin by placing a specially designed hammock above that area. The hammock would have three connection points: the main mast, the main boom, and a shroud. The hammock would be designed to maximize the space that is available above the main cabin.

There may be accessories, which may be added to the hammock such as an awning. The awning is not part of the invention but is used to illustrate that other items may be added to the hammock to improve its functionality. The addition of accessories could be used without detracting from the value of this invention and also not consume additional space on the sailboat.

The sailboat hammock is a hammock with a different purpose. It is made specifically for installation on a sailboat. One of the major problems on a sailboat is the extremely limited space that is available. This hammock will maximize the space that is available. It will take advantage of space that is normally not used on a sailboat.

BRIEF DESCRIPTION OF THE DRAWINGS

The invention is further described in connection with the accompanying drawings.

DETAILED DESCRIPTION OF THE DRAWINGS

Figure 1:
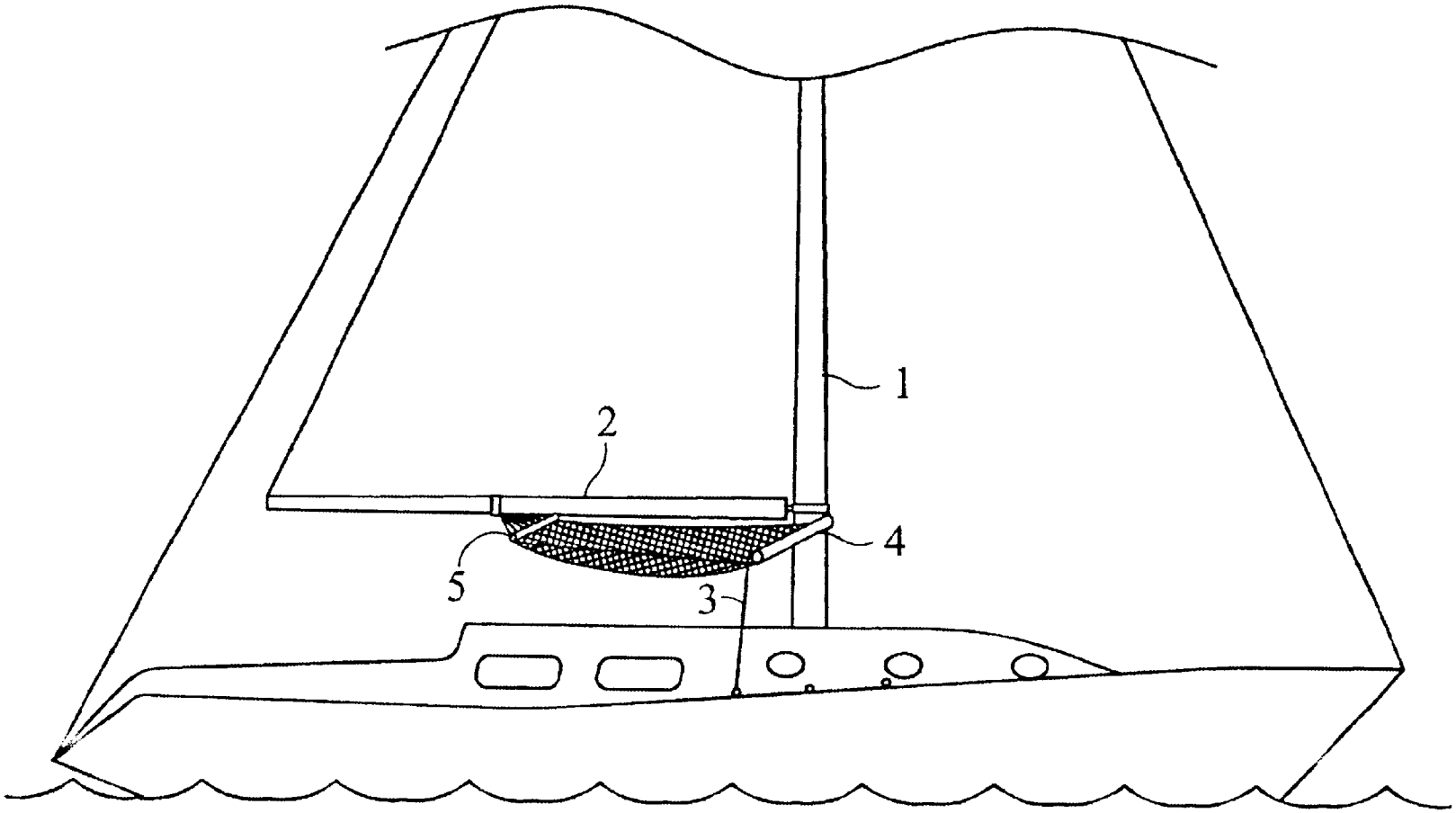
FIG. 1 is a perspective view of the hammock installed on a sailboat.

In FIG. 1 the hammock is pictured as installed from the side. It is attached to the main mast (#1), the boom (#2) and the shroud (#3). The hammock uses lines from the hammock to the attachment points. Other hardware such as snap shackles, snap hooks, or cinch straps may also be used to attach the lines that come from the hammock to the attachment points. The hammock is secured to the sailboat by these three points of attachment, which allow the user to be suspended above the main cabin top of the sailboat.

The head of the hammock is placed forward between the main mast and a shroud while the foot of the hammock is placed aft and affixed to the boom. This placement is required because of the difference in lengths of the spreader bars (#4, #5), which are employed in the hammock. The spreader bar at the head of the hammock (#4) is approximately twice as long as the spreader bar that is used at the foot of the hammock (#5); the difference in lengths is required in order to be able to place the hammock on the sailboat and avoid interference with the rigging of the sailboat. The hammock can be used on either side of the boom or two hammocks can be hung simultaneously, one on each side of the boom.

Figure 2:
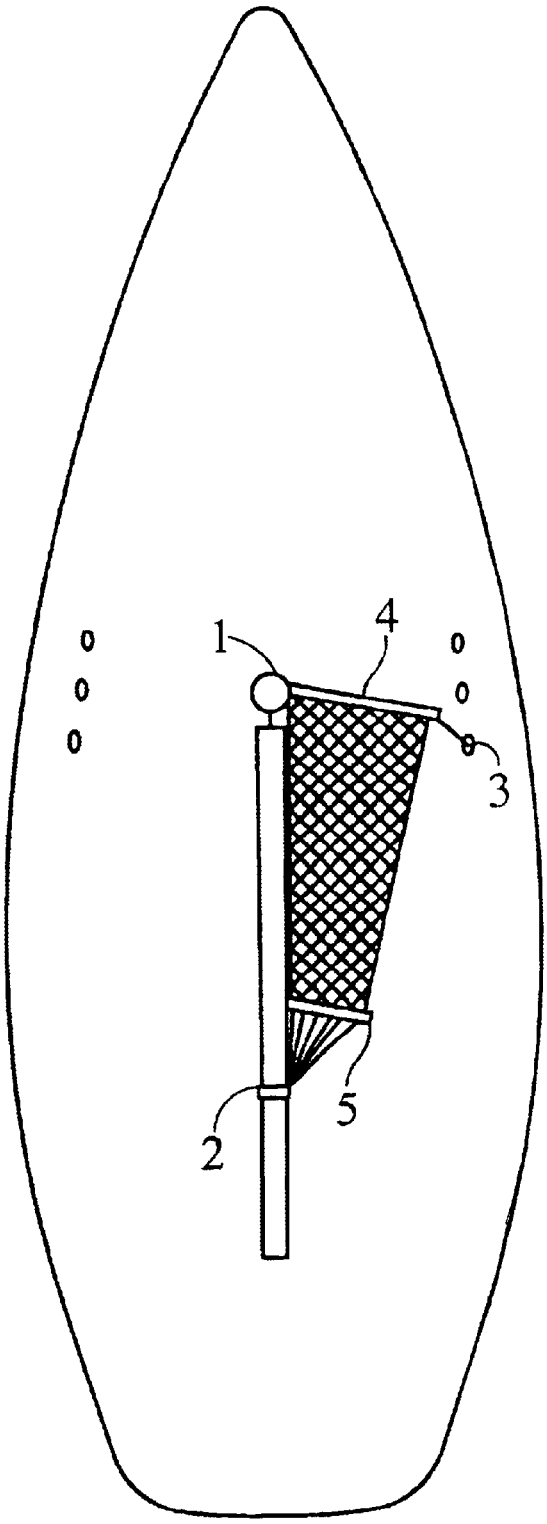
FIG. 2 is an aerial view of the sailboat hammock as installed.

In FIG. 2 the hammock is shown from an aerial view. This shows a better view of the attachment points particularly with regard to the shroud (#3) and main mast (#1). In order to properly function the hammock must have three points of attachment. Three points of attachment must be used to accommodate the movement of the sailboat and stabilize the hammock. The typical land hammock has two points of attachment and would be unstable aboard a sailboat because the movement that is encountered on a sailboat is not appreciated on land. The points of attachment may be varied depending on the type of vessel and what may be available aboard the particular type of sailboat.

The hammock has an asymmetrical design, which is wider at the head and narrower at the foot that allows for comfort as well as freedom from obstruction with the rigging of the boat.

Extra hardware may be utilized to attach the lines, which come the attachment points.

What is claimed is:

1. This is a device, which is a sailboat hammock, and is comprised of:

a. spreader bars;

b. points of connection/ and c. attachment points;

wherein the hammock has three points of connection:

the main mast, main boom and a shroud; and the hammock has a first end and second end;

wherein the spreader bar at the first end of the hammock is approximately twice the length of the spreader bar at the second end of the hammock.

* * * * *